United States Patent [19]

Seeley

[11] Patent Number: 4,952,246

[45] Date of Patent: Aug. 28, 1990

[54] PLANT AND METHOD FOR RECONDITIONING GREEN FOUNDRY SAND

[75] Inventor: Robert J. Seeley, Muncy, Pa.

[73] Assignee: Dependable Foundry Equipment Company, Inc., Sherwood, Oreg.

[21] Appl. No.: 397,754

[22] Filed: Aug. 23, 1989

[51] Int. Cl.[5] ..... C23G 1/02

[52] U.S. Cl. ..... 134/3; 134/10; 134/25.1; 134/28; 134/30; 164/5; 423/340

[58] Field of Search ..... 134/25.1, 2, 10, 13, 134/4, 109, 111, 26, 27–28, 3, 30; 164/5; 209/17, 211; 210/512, 512.1; 423/340; 106/482

[56] References Cited

U.S. PATENT DOCUMENTS

| | | | |
|---|---|---|---|
| 3,050,364 | 8/1962 | Segrove | 134/3 |
| 3,282,416 | 11/1966 | Colce | 423/340 |
| 3,297,402 | 1/1967 | Chubb | 423/340 |
| 4,113,510 | 9/1978 | Richard | 134/2 |
| 4,303,453 | 12/1981 | Jung et al. | 134/10 |
| 4,405,588 | 9/1983 | Caballero et al. | 423/340 |
| 4,478,572 | 10/1984 | Selli | 432/18 |
| 4,542,003 | 9/1985 | Watkins et al. | 423/340 |
| 4,685,973 | 8/1987 | Ashton | 134/13 |
| 4,709,862 | 12/1987 | Leidel | 241/23 |
| 4,799,530 | 1/1989 | Sturgis et al. | 164/5 |
| 4,804,422 | 2/1969 | Pupanikulau et al. | 134/3 |
| 4,815,516 | 3/1989 | Sturgis et al. | 164/5 |

*Primary Examiner*—H. M. S. Sneed
*Assistant Examiner*—Sharon T. Cohen
*Attorney, Agent, or Firm*—Klarquist, Sparkman, Campbell, Leigh & Whinston

[57] ABSTRACT

Green sand having a residuum of retained clay is reconditioned by screening and predrying it to about zero moisture; calcining the sand to burn off organic matter; cooling the sand; mechanically scrubbing the cooled sand to free mechanically bonded clay and a portion of the clay magnetically adhered to the sand; mixing an acid/water solution with the sand to react with the remaining magnetically adhered clay to permit such clay to break free from the sand; drying the sand to release the freed clay; and extracting the thus-released clay from the sand.

9 Claims, 2 Drawing Sheets

PLANT AND METHOD FOR RECONDITIONING GREEN FOUNDRY SAND

BACKGROUND OF THE INVENTION

This invention relates to the reclaiming or reconditioning of green foundry sand used in metal casting operations.

Green sand is a mixture of sand, clay, organic adhesion promoters and water used in the formation of molds into which molten metals are poured and allowed to cool sufficiently to permit a molded metal object to be removed therefrom without injury. Typically, green sand has a moisture content of between about three and four percent and a clay content of between about five and twelve percent by weight, with the moisture and clay being essentially uniformly distributed throughout the body of the mold prior to the introduction of the metal.

After the introduction of molten metal into a mold formed of green sand, the metal slowly solidifies. After solidification, the casting is separated from the molding sand and the sand is collected for further use. However, it is not possible to reuse all the sand. Therefore, it is common practice to add at the completion of each molding cycle, a predetermined percentage of new sand and clay and to remove an identical amount of old sand from the system. An obvious disadvantage of this procedure is that part of the discarded sand includes active binder or binder subject to reactivation, and such discarded sand must be disposed of. Federal and state environmental regulations relative to the disposal of foundry sands are becoming extremely strict. This in turn has forced the closure of many foundry landfill sites and dramatically increased disposal expense. Consequently, foundries are finding it necessary to reclaim and reuse green sand as a desirable alternative to the high cost and future liability associated with disposal of waste sand even in an approved landfill.

In most green sand foundry applications, the intended use for thermally reclaimed sand is in the production of nobake cores and to satisfy a portion of the required new sand that must be added to the molding green sand. However, at the present time there is no green sand reclamation process that can consistently produce a quality reusable sand.

If green sand is reclaimed thermally, it undergoes a dramatic pH elevation during the calcination step. Calcination is heating the sand to a high temperature. It is believed that retained clay is the source of the pH elevation, because if the same type of sand is coated with an organic nobake binder, it demonstrates little or no pH change during thermal reclamation. Consequently, thermal reclamation equipment manufacturers have concentrated their efforts on reducing the clay in the reclaimed sand.

Some marginal success has been experienced in thermally reclaiming specific sands, but even extensive mechanical scrubbing has not consistently produced a quality usable, thermally reclaimed sand. Even when the amount of retained clay is reduced below 0.25 percent, the pH of the thermally reclaimed green sand is too high to allow successful rebonding of the sand in an acid set nobake binder system.

Accordingly, it is a principal object of the present invention to provide a plant and a method for reclaiming or reconditioning green foundry sand that can be used to produce nobake cores and satisfy a portion of the required new sand that must be added to the molding green sand.

It is a further object of the present invention to provide a plant and a method that will produce thermally reclaimed sand which has a pH equal or less than the pH of new sand.

It is a still further object of the present invention to provide a thermally reclaimed or reconditioned green sand which when processed in test applications, rebonds at tensile strengths about equal to that of new sand.

Extensive mechanical scrubbing of thermally reclaimed green sand, as above noted, dramatically reduces the amount of retained clay, but often results in only a minimal reduction in pH. This phenomenon motivated me to evaluate what was happening to the sand and the clay during both the thermal calcining and the mechanical scrubbing functions. By using a 1000× microscope, I discovered that after thermal reclamation the surfaces of the individual clay grains appeared to be very rough. This surface roughness did not appear to have been caused by abrasion.

My examination revealed that the clay grain surfaces appeared to be flaking. From this I concluded that the individual clay grain itself was undergoing an ion structure change. I also discovered that small clay particles were adhering to the sand grains. The adhesion was not mechanical; it was magnetic. Larger clay particles were free of the sand, however as respects clay particles attached to the individual sand grains, if I attempted to free such a clay particle from a sand grain, it would reattach itself to the sand grain as soon as it could make contact. I thus concluded that the ion structure change occurred only on the surfaces of the clay particles.

My observations convinced me that the typical AFS clay analysis after calcination and extensive mechanical scrubbing, is not truly representative of the amount of retained clay. I believe that the amount of retained clay is two to three times as much as an analysis shows. I believe that all the retained clay adhered to the sand grains undergoes ion change and that this is the main source of pH elevation. I, believe this is the reason why the pH of the sand does not drop proportionately to the reduction in clay.

I have discovered that it is possible to reduce the pH and free adhered clay particles from the sand by mixing an acid/water solution with the sand after calcination and mechanical scrubbing. The solution reacts with the clay adhered to the individual sand grains so as to permit the adhered clay to break free therefrom. When the sand is then dried, the clay can be released from the sand grains and the freed clay particles extracted by fluidized air.

I have found that the acid/water solution has to be adjusted in volume and pH depending on the volume of retained clay and the pH of the thermally reclaimed sand after scrubbing and separation. My invention results in a thermally reclaimed green foundry sand that has a pH equal or less than the pH of new sand and has nearly all of the clay extracted. The clay that remains in the sand has the same pH as the sand.

SUMMARY OF THE INVENTION

My plant for reconditioning green foundry sand includes predrying means adapted to screen and dry the used sand almost to zero moisture. It further includes a fluid bed thermal calciner having means for feeding the dried and screened sand into a calcination bed where it is heated to vaporize and burn the organic materials therein. The plant further includes cooling means followed by scrubbing means for freeing clay mechanically bonded to the sand and a portion of the clay fines magnetically adhered to the sand. The plant further includes means for removing the clay freed by the scrubbing means. The plant also includes pH conditioning means for mixing an acid/water solution with the sand to react with the remaining magnetically adhered clay to permit the clay to break free from the sand and reduce the pH of the remaining sand. Drying means are provided to evaporate the acid/water solution, dry the sand and release the freed clay. Finally, means are provided to extract the clay released from the sand.

Preferably, the cooling means comprises a cooler/-classifier adapted to reduce the temperature of the sand from the temperature achieved in the calciner to about 90° F. The scrubbing means also comprises fluidizing means to fluidize the scrubbed sand.

The pH conditioning means comprises a pH conditioning mixer, means to inject the acid/water solution into the mixer, and means thoroughly to mix the acid/-water solution and the sand within the mixer to achieve uniform pH reaction and stimulate ion restructuring.

The drying means comprises means for fluidizing the sand received from the pH conditioning means. The drying means further comprises means to supply to the fluidizing means hot air received from the thermal calciner.

The method of my invention comprises screening and predrying used green sand almost to zero moisture, calcining the sand to vaporize and burn organic matter contained therein, cooling the sand, scrubbing the sand to free mechanically bonded clay and a portion of the clay magnetically adhered to the sand, removing the clay freed by the scrubbing, mixing an acid/water solution with the sand to react with the remaining clay magnetically adhered to the sand to permit the remaining magnetically adhered clay to break free from the sand, drying the sand to release the clay freed by the reaction of the acid/water solution with the sand, and extracting the thus released clay from the sand.

The sand is preferably calcined at a temperature of between about 1400° and 1650° F. for between about forty minutes and one hour.

Preferably, the method is such that the free clay level in the sand is less than about 0.10 percent by weight at the time of pH conditioning. This is so because I have found that excessive free clay dramatically increases the acid/water input requirement because of its absorption characteristics after calcining.

The mixing of the acid/water solution during the pH conditioning comprises evenly distributing the acid/-water solution in the sand to ensure uniform pH reaction and to stimulate ion restructuring. I have found that the acid/water pH requirement will vary from foundry to foundry based upon the pH of the sand and the volume of retained clay in the sand.

Preferably, my method comprises drying the sand mixed with the acid/water solution by fluidizing the sand with air at a temperature below about 300° F. to ensure that the pH reaction and ion restructuring are not inhibited. The drying-fluidizing step preferably has at least a forty-minute retention time to ensure maximum separation of freed clay particles. This reduces the sand binder recoating requirements and improves tensile strengths.

The sand must be dried to almost zero moisture and classified prior to calcining because moisture creates a negative combustion environment in the calciner. The classification also reduces the clay content in the sand by about fifty percent prior to calcining. These two steps aid in controlling the clay/sand cinder problem and achieve a low pH climb.

DETAILED DESCRIPTION OF A PREFERRED EMBODIMENT

Figure 2:
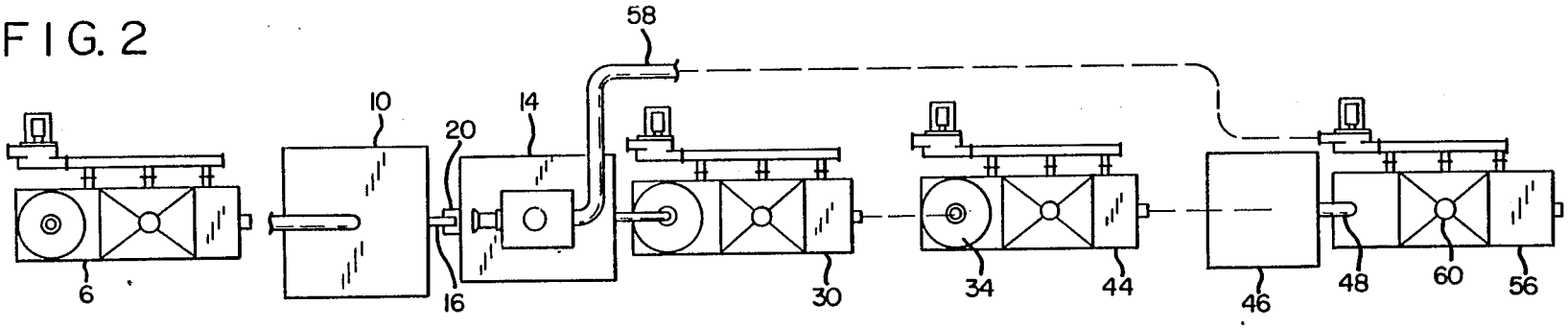
FIG. 2 is a plan view of the plant of FIG. 1.
Figure 1:
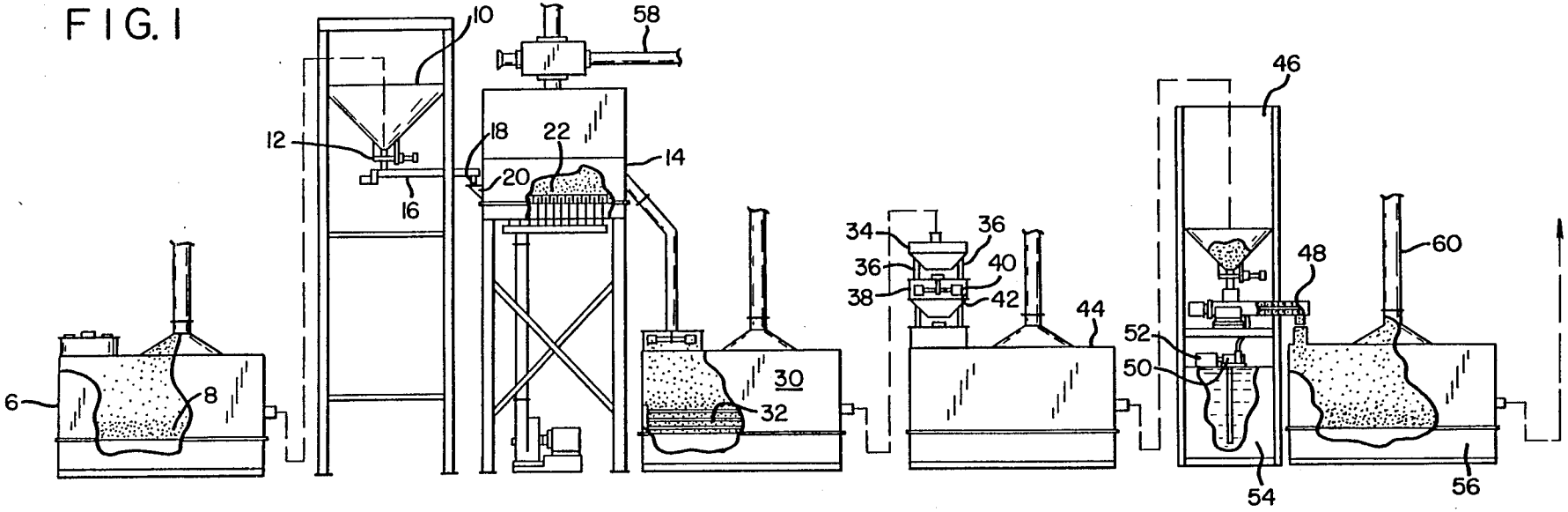
FIG. 1 is an elevational view, partly schematic, of a green foundry sand reconditioning plant in accordance with the present invention.
Figure 3:
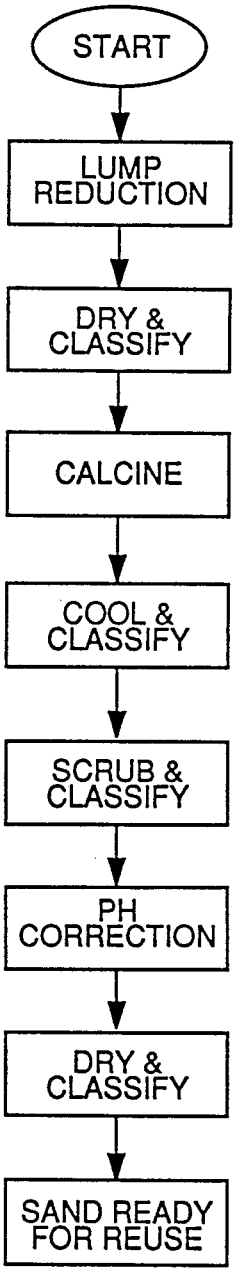
FIG. 3 is a flow diagram of the process.

Primarily as shown in FIGS. 1 and 2, the first step in my green sand reconditioning process is to reduce sand lumps and core pieces to near grain size. This is done using a multi-deck, high frequency, low amplitude mechanical lump reducer (not shown). In the lump reducer the lumps of sand are reduced to near grain size by sand-grain-to-sand-grain contact abrasion as the sand passes through the several decks. The final deck is a twelve-mesh heavy wire screen which only passes a 3/32 inch diameter particle, thereby to insure reduction to the desired size.

As the lumps of used green sand are reduced to near grain size, the sand and the clay are exposed to free air; in turn a portion of the moisture retained in the green sand evaporates. By the time the green sand has passed through the twelve-mesh deck, the moisture content is reduced by at least twenty-five percent and the sand is more flowable.

The sand is then conveyed to a predrying and clay separating fluid bed dryer/classifier 6 which dries the sand to almost zero moisture and achieves almost a fifty percent reduction in the total clay. Dryer/classifier 6 is supplied with 250° to 300° F. fluidizing air, which is preferably waste heat from the calciner. As the hot air fluidizes the sand, the remaining moisture in the sand is flashed to vapor and is exhausted from dryer/classifier 6.

As the moisture flashes from the clay, the clay begins to free itself from the sand grains. The dry clay particles have a lower specific gravity than the sand and rise from the sand bed 8 into the dust collection air stream where they are captured and transported to a dust collector (not shown). The pressure drop across dryer/-classifier 6 is about one-half inch.

The green sand is retained in dryer/classifier 6 for approximately one hour. As above noted, about fifty percent of the total clay is extracted during this predrying and classifying step.

By eliminating almost all the moisture from the sand and reducing the clay content by about half before calcining the sand, the pH of the sand increases less than it increases using present technology. Green sand thermally reclaimed using present technology typically has a pH of about 9.4. Using my invention, the pH of the sand climbs one full point less, that is, the pH of the reclaimed sand is about 8.4 instead of 9.4.

The dried and classified sand is then delivered to a staging hopper 10. The sand is conveyed from hopper 10 through a variable flow rating gate 12 to a fluid bed thermal calciner 14 by a variable speed screw feeder 16, which allows the foundry to vary the process volume of the system from a maximum rate down to any desired process rate. Sand falls from the discharge outlet 18 of feeder 16 into the inlet 20 of calciner 14 forming a calcination bed 22.

The temperature of the sand is elevated to between about 1400° and 1650° F. in the calciner 14. At this temperature all of the organic material is combusted. The sand retention time in calciner 14 is from about forty minutes to about one hour.

Because a portion of the clay and organic binder as well as all of the moisture are removed prior to calcining, the calcining function is more effective. The pH remains lower by at least one full point, as above noted. The loss of ignition (LOI) is less than one-half. And the presence of cindered clay and carbon is dramatically reduced.

Sand discharged from calciner 14 falls into fluid bed cooler/classifier 30 in which the sand is fluidized around a water-cooled stainless steel heat exchanger tube bank assembly 32 which cools the sand from its thermal reclamation discharge temperature to approximately 90° F. As the sand undergoes the fluidizing and cooling process step, clay freed by the thermal calcining step is separated from the sand bed and transported to the dust collector (not shown). The clay has a lower specific gravity than sand, thus it becomes airborne at the sand fluidization pressure. The retention time in cooler/classifier 30 is about forty minutes.

The cooled sand is discharged from cooler/classifier 30 into the scrubbing means which desirably comprises a first hopper 34 which receives the sand and discharges it through tubes 36 into an impingement chamber 38 where rotating hammers 40 strike the sand and hurl it against the interior surface 42 of the chamber 38. This insures that the bond between the sand and the clay is broken. Many of the small clay particles remain magnetically adhered to the sand grains, but the larger mechanically bonded clay particles are removed from the sand grains. From the chamber 38 the sand is discharged into a fluid bed classifier 44 where the larger clay particles are extracted from the sand bed by the fluidizing action and from which they are transported to the dust collector. Scrubbing means suitable for the invention is sold by Dependable Foundry Equipment Company, Sherwood, Oreg., under the trademark "ROTACLAIM".

The sand discharged from classifier 44 is transported to a sand surge hopper 46 which is positioned over a high intensity, continuous flow pH conditioning mixer 48. At the same time the sand is metered from hopper 46 into mixer 48 an acid/water solution is injected into the sand in the mixer by a positive displacement acid/water pump 50 powered by a motor 52 located on top of an acid/water tank 54. The sand and the acid/water solution are thoroughly mixed in mixer 48. Within a few seconds the negative ion charge of the clay fines is reacted and the clay particles begin to break free from the sand grains. The sand is then discharged into a dryer/classifier 56. I have found that an acid/water solution suitable for this invention comprises hydrochloric acid (pH=0.1) mixed with water in a 1:2 (acid:water) ratio by volume. A mixer 48 suitable for the invention is sold by Dependable Foundry Equipment Company, Sherwood, Oreg., under the trademark "CHALLENGER 50."

The pH conditioned sand is fluidized in dryer/classifier 56 using 300° F. air. The air is preferably supplied from the high temperature exhaust system of calciner 14 through line 58. As the acid/water solution evaporates and the sand dries, the clay particles begin to float free in the fluidizing air. The particles are then captured in the exhaust air stream 60 whence they are transported to the collector. The dried, pH adjusted and nearly clay free sand is discharged from dryer/classifier 56 into a sand distribution transporter whence it is delivered to storage hoppers (not shown) in the core room and to the new sand staging hopper (also not shown).

Green sand to be reconditioned typically has between seven and nine percent clay by weight at the start of the reconditioning process. After the process of my invention the sand has between 0.1 and 0.3 percent clay by weight. A comparison of raw new sand, green sand thermally reclaimed by current technology, and green sand thermally reclaimed by the method and using the plant of this invention shows the following:

TEST DATA

| | Raw New Sand from Supplier | Green Sand Thermally Reclaimed by Current Techonology | Green Sand Thermally Reclaimed by this Invention |
|---|---|---|---|
| Loss of Ignition (LOI), % | 0.09 | 0.03 | 0.01 |
| pH | 7.3 | 9.2 | 6.9 |
| Binder Acid Demand Value (ADV) | 1.3 | 5.7 | 1.1 |
| Tensile Strength (cured), psi, at | | | |
| 1 minute | 124 | 55 | 118 |
| 5 minutes | 168 | 72 | 149 |
| 1 hour | 209 | 91 | 201 |
| 24 hours | 239 | 119 | 227 |
| Bench life, psi, 24 hours | 218 | 0 | 208 |

EXAMPLE

A sample of 2000 grams of used green sand was reconditioned according to this invention. The sand has 8.5 percent active clay be weight which broke down as follows:

| | |
|---|---|
| Western Bentonite | 70% |
| Southern Bentonite | 10% |
| Seacoal | 20% |
| | 100% |

The sand had 3.3 percent moisture by weight.

The sand was predried and fluidized for sixty minutes at 250° F. at which time there was no readable moisture and the amount of clay was reduced by from fifty to sixty percent by weight.

The sand then was calcined for one hour at 1600° F., after which it was classified and cooled to 90° F. After extraction, the remaining clay was five percent by weight. The sand then was impingement scrubbed after which the amount of clay was reduced to 0.2 percent by weight and the pH was 8.5. The sand was then pH conditioned using a solution of 0.1 pH hydrochloric acid in a 1:3 (acid:water) ratio by volume. The solution was added at a rate of 3.5 percent by weight of sand and solution.

The sand was discharged to a dryer/classifier where it was fluidized for one hour at 250° F. The reconditioned sand had the following properties:

| | |
|---|---|
| LOI | 0.01% |
| pH | 6.9 |
| ADV | 1.1 |

I claim:

1. A method for reconditioning used green sand having a residuum of retained clay, comprising:

screening and predrying used green sand to about zero moisture;

calcining the sand to vaporize and burn organic matter contained therein;

cooling the calcined sand;

mechanically scrubbing the cooled sand to free mechanically bonded clay and a portion of the clay magnetically adhered to the sand;

removing the clay freed by the mechanical scrubbing;

mixing an acid/water solution with the sand to react with the remaining clay magnetically adhered to the sand to permit said remaining magnetically adhered clay to break free from the sand;

drying the sand to release the clay freed by the reaction of the acid/water solution with the sand; and extracting the thus released clay from the sand.

2. The method of claim 1 in which the amount of clay in the sand is reduced to less than about 0.10 percent by weight at the time of mixing the acid/water solution therewith.

3. The method of claim 1 in which the mixing of the acid/water solution comprises evenly distributing the acid/water solution in the sand to ensure uniform pH reaction and to stimulate ion restructuring.

4. The method of claim 1 in which the drying of the sand mixed with the acid/water solution is at a temperature of below about 300° F.

5. The method of claim 1 in which the drying of the sand mixed with the acid/water solution is achieved by fluidizing the sand with air at a temperature below about 300° F.

6. The method of claim 1 in which the mixture of acid/water solution and sand is dried for at least forty minutes.

7. The method of claim 1 in which the sand is calcined at a temperature of between about 1400° and 1650° F. for between about forty minutes and one hour.

8. The method of claim 1 wherein the calcined sand is cooled from the temperature achieved during calcining to about 90° F.

9. The method of claim 8 in which the cooling of the calcined sand is achieved by fluidizing the sand.

* * * * *